United States Patent [19]

Kleber et al.

[11] 4,399,245

[45] Aug. 16, 1983

[54] SIZING AGENT FOR SYNTHETIC FIBERS

[75] Inventors: Rolf Kleber, Neu-Isenburg; Herbert Stühler, Burgkirchen, both of Fed. Rep. of Germany

[73] Assignee: Hoechst Aktiengesellschaft, Fed. Rep. of Germany

[21] Appl. No.: 350,302

[22] Filed: Feb. 19, 1982

[30] Foreign Application Priority Data

Feb. 25, 1981 [DE] Fed. Rep. of Germany ..... 3107008

[51] Int. Cl.[3] ..... C08K 5/15

[52] U.S. Cl. ..... 524/108; 524/377

[58] Field of Search ..... 524/108, 377; 523/222

[56] References Cited

U.S. PATENT DOCUMENTS 3,277,041 10/1966 Sieg et al. ..... 524/108
4,119,604 10/1978 Wysong ..... 524/377

FOREIGN PATENT DOCUMENTS 1903280 10/1970 Fed. Rep. of Germany ..... 524/377
666274 2/1952 United Kingdom ..... 524/377

OTHER PUBLICATIONS

Fieser and Fieser, Organische Chemie 1968, p. 1230, "Polyglycerols".

*Primary Examiner*—Joseph L. Schofer
*Assistant Examiner*—N. Sarofim
*Attorney, Agent, or Firm*—Connolly and Hutz

[57] ABSTRACT

A sizing agent consisting substantially of polyvinyl alcohol and polyglycerol.

2 Claims, No Drawings

SIZING AGENT FOR SYNTHETIC FIBERS

Sizing of hydrophilic fibers, for example cellulose, by means of polyvinyl alcohol (PVA) is state of the art. Especially polyvinyl alcohols of different saponification degree, that is, different content of residual acetyl, have proved useful sizing agents in the industrial practice. Difficulties arise, however, when sizing hydrophobic fibers such as polyesters with polyvinyl alcohol, because the film of size on the fibers is very brittle and may cause flaws on weaving by splintering off. In C. A. Finch, Polyvinyl-alcohol, 1973, p. 260 et sequ., a sizing agent composition for polyesters is therefore described which consists of polyvinyl alcohol and polyacrylate. Although the acrylate size admixed adheres very well to the polyester, it causes an undesirable increase of hygroscopicity of the size film on the fiber. It was therefore the object of the invention to find improved additives which ensure optimum sizing of synthetic fibers with polyvinyl alcohol.

In accordance with the invention, there has been found that sizes of polyvinyl alcohol are made flexible and soft for useful application in the sizing of synthetic fibers, especially polyesters, by adding a polyglycerol to the polyvinyl alcohol size.

Subject of the invention is a sizing agent consisting substantially of a polyvinyl alcohol and from 5 to 30, preferably 8 to 15, weight % relative to the weight of the polyvinyl alcohol, of a polyglycerol of the formulae $$HOCH_2-CHOH-CH_2\left(O-CH_2-CHOH-CH_2\right)_n-O-CH_2-CHOH-CH_2OH$$

or

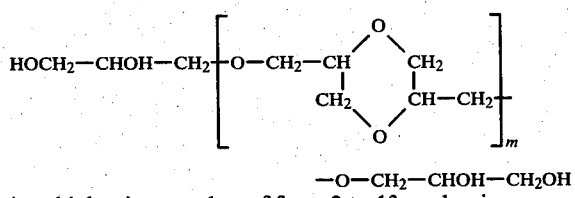

in which n is a number of from 2 to 13, and m is a number of from 1 to 7.

For the sizing agent, polyvinyl alcohol having a viscosity as low as possible is used, for example types having a residual acetyl content of from 1 to 15% and a viscosity of from 4 to 18 mPas, measured at 20° C. on a 4% aqueous solution. The polyglycerols are known from Fieser and Fieser, Organische Chemie 1968, p. 1230. These polyglycerols are preferably added to the hot, aqueous liquor of the polyvinyl alcohol. The concentration of the sizing agent, that is, the mixture of polyvinyl alcohol and polyglycerol, in the size liquor is generally from 2 to 20 weight %.

In addition to the polyvinyl alcohol and the polyglycerol, other additives such as emulsified fats, mineral oils, antioxidants, starch, starch ethers etc. may be added to the size liquor. The sizing agent of the invention is excellently suitable for the sizing of hydrophobic synthetic fibers such as polyacrylonitrile, polypropylene and especially polyesters, furthermore mixtures of these fibers with natural fibers, or cellulose-2½ acetate or cellulose triacetate fibers. The layer of sizing agent on the yarn is in the normal range of the industrial practice, for example from 6 to 8 weight % for a warp of texturized polyester fibers.

Due to the addition of the polyglycerols, transparent size films of high flexibility are obtained. The polyglycerols do not exude from the dried films and do not increase their hygroscopicity, but increase the adhesive powder of the PVA sizes.

The following Example illustrates the invention.

EXAMPLE

Texturized polyester fibers (dtex 167 f 32) were sized with the following products at a layer thickness of 6 weight %:

(a) polyvinyl alcohol (PVA), residual acetyl content: 10.7%, viscosity of a 4% aqueous solution at 20° C.=4 mPas (comparison)

(b) PVA according to (a) and 10 weight % of diglycerol (comparison)

(c) PVA according to (a) and 10 weight % of pentaglycerol (according to invention)

(d) PVA according to (a) and 10 weight % of nonaglycerol (according to invention)

(e) PVA according to (a) and 10 weight % of pentadecaglycerol (according to invention)

For the length of adhesion and the water uptake of the fibers so treated the following data were obtained:

Length of Water uptake after heating for 1 hour to 105° C. adhesion at 65% rel. moisture, at 80% rel. moisture

| | | |
|---|---|---|
| (a) = 2100 m | 8 | 18 |
| (b) = 2000 m | 12 | 30 |
| (c) = 2150 m | 8 | 20 |
| (d) = 2400 m | 8 | 20 |
| (e) = 2500 m | 8 | 21 |

With respect to stiffness in flexure, abrasion and filament bond, the specimens gave the following results:

Stiffness in flexure:

specimens (a) and (b): insufficient specimens (c), (d) and (e): good.

Abrasion in sewing machine test (3 minutes at 70% relative moisture):

specimens (a) and (b): much abrasion with yarn breakage occurring specimens (c), (d) and (e): extremely low abrasion, no yarn breakage.

Filament bond (finger nail test):

specimens (a) and (b) were somewhat opened or opened specimens (c), (d) and (e) were tightly closed and showed high filament bond.

What is claimed is:

1. Sizing agent consisting substantially of a polyvinyl alcohol and from 5 to 30 weight % of a polyglycerol of the formulae $$HOCH_2-CHOH-CH_2\left(O-CH_2-CHOH-CH_2\right)_n-O-CH_2-CHOH-CH_2OH$$

or

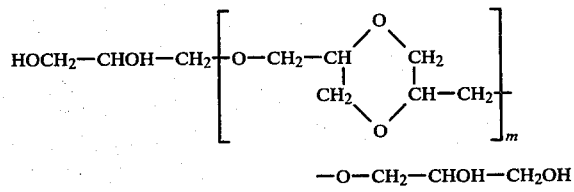

in which n is a number of from 2 to 13, and m is a number of from 1 to 7.

2. Sizing liquor containing from 2 to 20 weight % of the sizing agent as claimed in claim 1.

* * * * *